US006918976B2

(12) United States Patent
Sato et al.

(10) Patent No.: US 6,918,976 B2
(45) Date of Patent: Jul. 19, 2005

(54) GAS GENERATING COMPOSITION

(75) Inventors: Eishi Sato, Himeji (JP); Dairi Kubo, Himeji (JP); Kenjiro Ikeda, Himeji (JP)

(73) Assignee: Nippon Kayaku Kabushiki-Kaisha, Tokyo (JP)

( * ) Notice: Subject to any disclaimer, the term of this patent is extended or adjusted under 35 U.S.C. 154(b) by 0 days.

(21) Appl. No.: 10/679,384

(22) Filed: Oct. 7, 2003

(65) Prior Publication Data

US 2004/0069383 A1 Apr. 15, 2004

Related U.S. Application Data

(62) Division of application No. 09/623,043, filed as application No. PCT/JP99/00835 on Feb. 24, 1999, now abandoned.

(30) Foreign Application Priority Data

Oct. 31, 2000 (JP) ..... 10-043271

(51) Int. Cl.[7] ..... C06B 45/10; C06B 29/22
(52) U.S. Cl. ..... 149/19.1; 149/61; 149/76
(58) Field of Search ..... 149/19.1, 61, 76

(56) References Cited

U.S. PATENT DOCUMENTS

| | | | | |
|---|---|---|---|---|
| 4,948,439 A | | 8/1990 | Poole et al. | |
| 5,472,647 A | | 12/1995 | Blau et al. | |
| 5,516,377 A | | 5/1996 | Highsmith et al. | |
| 5,551,725 A | | 9/1996 | Ludwig | |
| 5,756,929 A | | 5/1998 | Lundstrom et al. | |
| 5,780,768 A | | 7/1998 | Knowlton et al. | |
| 5,861,571 A | | 1/1999 | Scheffee et al. | |
| 5,883,330 A | | 3/1999 | Yoshida | |
| 5,962,808 A | | 10/1999 | Lundstrom | |
| 6,033,500 A | | 3/2000 | Ito et al. | |
| 6,123,359 A | * | 9/2000 | Cabrera et al. | 280/741 |
| 6,562,087 B1 | | 5/2003 | Kodama et al. | |

FOREIGN PATENT DOCUMENTS

| | | |
|---|---|---|
| JP | 5-294773 | 11/1993 |
| JP | 9-510429 | 10/1997 |
| WO | WO 97/05087 | 2/1997 |

* cited by examiner

*Primary Examiner*—Aileen Felton
(74) *Attorney, Agent, or Firm*—Oblon, Spivak, McClelland, Maier & Neustadt, P.C.

(57) ABSTRACT

A gas generating composition which contains a nitrogenous organic compound as a fuel component and generates, at a high gasification rate, a clean gas harmless to the human body. The composition of the present invention comprises a nitrogenous organic compound as a fuel component and ammonium perchlorate and the nitrate of an alkaline metal or alkaline earth metal as oxidizing agents, wherein where a quantity of nitrate required solely for forming an oxide of alkaline metal or alkaline earth metal that can stoichiometrically neutralize hydrogen chloride generated from ammonium perchlorate is taken as 1, a quantity of nitrate of said alkaline metal or alkaline earth metal exceeds 0.9.

4 Claims, 4 Drawing Sheets

Fig. 4

COMPOSITION RATIO AND TANK TEST RESULTS

| COMPOSITION | EXAMPLES | | | | COMPARATIVE EXAMPLES | | | |
|---|---|---|---|---|---|---|---|---|
| | 1 | 2 | 3 | 4 | 1 | 2 | 3 | 4 |
| Nitroguanidine | 49.0 | 40.0 | - | - | 51.7 | - | Same as Comparative Example 1 | Same as Comparative Example 2 |
| Aminotetrazole | - | - | 33.0 | 33.7 | - | 32.6 | | |
| $NH_4ClO_4$ | 22.0 | 25.0 | 30.1 | 30.2 | - | - | | |
| $Sr(NO_3)_2$ | 22.4 | 25.8 | 30.1 | - | 41.7 | 60.6 | | |
| $KNO_3$ | - | - | - | 29.7 | - | - | | |
| HTS | 4.5 | 2.4 | 4.7 | 4.7 | 4.5 | 4.7 | | |
| $MoO_3$ | 0.9 | 0.9 | 0.9 | 0.5 | 0.9 | 0.9 | | |
| $Si_3N_4$ | 0.9 | 0.9 | 0.9 | 0.9 | 0.9 | 0.9 | | |
| Carboxy-methylcellulose Na | - | 5.0 | - | - | - | - | | |
| St-Mg | 0.3 | - | 0.3 | 0.3 | 0.3 | 0.3 | | |
| Performance Test | | | | | | | | |
| Amount of Agent Used | 25g | 25g | 25g | 25g | 25g | 25g | 44g | 44g |
| t2(ms) | 59.2 | 52.0 | 56.0 | 47.0 | 75.2 | 71.0 | 54.0 | 55.0 |
| Pl(Kpa) | 184 | 178 | 174 | 170 | 98 | 84 | 188 | 178 |
| CO(ppm) | 4000 | 4200 | 4500 | 3000 | 5500 | 5200 | 9200 | 8000 |
| NOx(ppm) | 320 | 280 | 200 | 150 | 1600 | 1400 | 3000 | 2500 |
| HCl(ppm) | 2 | 2 | 2 | 3 | N.D. | N.D. | N.D. | N.D. |
| $Cl_2$(ppm) | N.D. | N.D. | N.D. | N.D. | N.D. | N.D. | N.D. | N.D. |
| Quantity of Slag Overflown (g) | 1.1 | 1.2 | 0.7 | 1.4 | 0.8 | 0.6 | 2.0 | 2.1 |
| Automatic Ignition Capability | with | with | with | with | - | - | without | Without |

(NOTE) ABBREVIATION IN TABLE

HTS: Synthetic hydrotalcite

St-Mg: Magnesium stearate

N.D.: Not Detected

Fig. 5

COMBUSTION TEST AND HEAT RESISTANCE TEST

| | EXAMPLE 5 | EXAMPLE 6 | COMPARATIVE EXAMPLE 5 |
|---|---|---|---|
| t1 | 1.20 | 1.18 | 1.06 |
| t2 | 5.52 | 5.48 | 5.06 |
| PI | 58.2 | 55.1 | 55.6 |
| CO (ppm) | 900 | 750 | 4500 |
| NOx (ppm) | N. D. | N. D. | N.D. |
| HCl (ppm) | N. D. | N. D. | N.D. |
| $Cl_2$ (ppm) | N. D. | N. D. | N.D. |
| Weight Reduction (%) | 0.13 | 0.14 | 3.90 |

GAS GENERATING COMPOSITION

Divisional of prior application Ser. No.: 09/623,043 filed Aug. 25, 2000, now abandoned, which is a 371 of PCT/JP99/00835 filed Feb. 24, 1999.

TECHNICAL FIELD

The present invention relates to a gas generating agent for use in a gas generator for an occupant protection device using explosive and, more particularly, relates to a novel composition for generating gas in which a quantity of contained detrimental composition such as nitrogen oxide and carbon monoxide is small and gasification rate is high.

BACKGROUND ART

An airbag system and a seatbelt pre-tensioner, which are occupant protecting systems, have been widely adopted in recent years for improving safety of the occupants in an automobile. The principle of the airbag system operation is that a gas generator is operated under control of signals from a sensor detecting a collision so as to inflate an airbag between occupants and a car body. The principle of the seatbelt pre-tensioner operation is substantially same, that a gas generator is operated under control of signals from a sensor detecting a collision so as to put occupants under constraint with seatbelts for protection. It is required of the gas generator to have a function for producing clean gas containing no harmful gas with a required and sufficient amount in a short time. And also it is required of the gas generator to be small in size and light in weight.

The gas generating agents for use in the gas generator are formed into a pellet form or a disc-like form by extrusion or pressure molding for stabilization of the burning. And it is required of the gas generating agents to maintain their initial combustion behavior over a long time even under various harsh environments. When the pellets deform or decrease in strength due to deterioration with age or change of environments and the like, the flammability of the explosive compositions will vary from that of the initial design then exhibit an abnormal combustion behavior. As a result of this, there is a possibility that the airbag or the gas generator may be broken itself in the event of the car-crash. In this case, it is failed to accomplish the aim of protecting the occupants. And there is even a possibility to cause them injury.

Gas generating agents containing metal azides such as sodium azide and potassium azide as their major component have been used as gas generating agents satisfying those required functions.

These known gas generating agents are widely used in terms of their various advantages such thet they are burnt immediately, the component of combustion gas is substantially nitrogen gas only, harmful gas such as CO (carbon monoxide) or NOx (nitrogen oxide) is not produced and it is easy to design the gas generator since the burning velocity is little influenced by the environment or the structure of the gas generator.

However, the metal azides have notable problems such that the metal azides itself are a harmful material, it produces azide easy to explode by impact and friction due to its contact with the heavy metal and it has decompose under the presence of water and acid then produce harmful gas. Thus, the metal azides must be handled with the greatest possible caution.

As the substitution of metal azides, gas generating agents containing tetrazoles, azodicarbonamides and other nitrogenous organic compounds as fuel components are proposed by, for example, Japanese Laid-open Patent Publications No. Hei 2(1990)-225159, No. Hei 2(1990)-225389, No. Hei 5(1993)-213687, No. Hei 6(1994)-32689 and No. Hei 6(1994)-80492, No. Hei 6(1994)-239684, No. Hei 7(1995)-206569 and No. Hei 7(1995)-206570.

The tetrazoles in particular are thermally stable and have a high proportion of atoms of nitrogen in their molecular structure, and thus have the property of inherently suppressing the production of CO. However, these involve the problem of readily producing NOx. So then, Japanese Laid-open Patent Publications No. Hei 2(1990)-225159 and No. Hei 3(1991)-208878 propose a method in which the gas generator is provided with a venturi means for introducing air into the combustion gas from outside so as to reduce the concentration of NOx as a whole. However, this method failed to clear up this problem essentially.

When nitrogenous organic compound is used as fuel, nitrate such as alkaline metal or alkaline earth metal, perchlorate or chlorate is generally used as an oxidizing agent for burning the nitrogenous organic compound. The alkaline metal or the alkaline earth metal contained in the oxidizing agent produces slag in the form of oxide or chloride as a result of the burning reaction. The proportion of the slag to the combustion products is not a little.

The occupant protection device may not serve since the oxide and chloride are harmful material for a human body and environment, and the oxide may cause damage to air bags to flow out of the gas generator. Accordingly, the oxide and chloride must be converted into slag in an easily collectable form, then the slag must collected in the gas generator. However, many of the gas generating agents using the nitrogenous organic compound as fuel have the calorific value as high as 2,000–3,000 joule/g or more. So, temperature and pressure of generated gas is high. Also temperature and flowability of slag is high, which is a by-product made in the burning of the gas generating agents. As a result of these, the slag collection efficiency of a filter fitted in a conventional type of gas generator tends to reduce. In order to increase slag collection efficiency, a method may be conceivable, wherein the slag is cooled and solidified by increased number of filtering members set in the gas generator. But such a method has a disadvantage of increasing the size of the gas generator, going against the trend toward the size reduction and weight reduction of the gas generator.

Japanese Laid-open Patent Publication No. Hei 4(1992)-265292 discloses another method for collecting the oxide of alkaline metal or alkaline earth metal which is produced in the reaction for burning the nitrogenous organic compound, wherein the oxide is converted into slag in the filtering part, the slag has a form easily collected, the slag is efficiently collected. According to this method, silicon dioxide or aluminum oxide is added as an acid or neutral slag forming agent that easily causes a slag-forming reaction with the oxides of alkaline metal or alkaline earth metal which are basic substances. However, those compounds do not in any manner contribute to the production of gas in the combustion reaction, thus resulting in reduction of the rate of gasification. Accordingly, the inventors have studied on how to improve the rate of gasification (a quantity of generated gas per unit weight of the gas generating agent) by using an oxidizing agent that produces no solid slag or a possible smallest quantity of solid slag after the combustion reaction, if any, as the oxidizing agent for the composition of the gas generating agent.

Ammonium nitrate and ammonium perchlorate can be cited as the oxidizing agent that produces no solid slag after combustion. One of the disadvantages that may arise from the use of ammonium nitrate as the oxidizing agent is that that substance causes various crystalline phase changes, among which the crystalline phase change that is caused at about 32° C. involves a great volume change. When the gas generating agent is repeatedly exposed to the crystalline phase changes above and below of that temperature range, the crystals of the ammonium nitrate expand and contract repeatedly to cause reduction in strength of or decay of the press-formed tablets of the gas generating agent which may become a possible cause of an abnormal combustion. For avoidance of this problem, a phase stabilizing method for ammonium nitrate is disclosed by PCT WO95/04710.

The ammonium nitrate is very low in reactivity, so a hazardous fuel component such as triaminoguanidine nitrate must be used to compensate for its hard burning property. Thus, the use of the ammonium nitrate as the oxidizing agent involves unavoidable problems of improvements in heat resistance and flammability.

On the other hand, the gas generating agents using the ammonium perchlorate are disclosed by Japanese Laid-open Patent Publications No. Hei 2(1990)-293389, No. Hei 5(1993)-221770 and No. Hei 8(1996)-228288. These are all produced by making use of the technology of propellant and are characterized by the use of a binder doubling as fuel. The binders doubling as the fuel that may be used include organic polymeric material, such as terminated hydroxyl polybutadiene, and silicon resin. The use of the organic polymeric material as the fuel constituent involves the inherent problem of increase in CO concentration in generated gas or aged deterioration resulting from the lack of heat resistance. Japanese Laid-open Patent Publications No. Hei 2(1990)-225159 and Hei 3(1991)-208878 disclose examples using nitrogenous organic compound as the fuel component and the ammonium perchlorate as the oxidizing agent. However, the composition of the gas generating agents could not be used singly for the protection of automobile occupants because of the poorness of the generated gas after combustion. Nevertheless, ammonium perchlorate is an interesting oxidizing agent in terms of heat resistance and reactability as the oxidizing agent, as compared with ammonium nitrate.

On the other hand, as a substitute for conventional stainless steel (SUS), aluminum is being widely used as a container material of the gas generator, for the purpose of weight saving of the gas generator. In the case of the container made of SUS, because of its excellent strength in high temperature, even when a temperature rise is caused by car fire, incineration of the gas generator or the like, no fracture of the container is caused and the composition of the gunpowder can be burnt out. In the case of the container made of aluminum, since its strength reduces significantly in high temperature, when the gas generator is exposed to flame of the car fire and the like and the composition of the gunpowder loaded in the interior is burnt, it is feared that the container cannot withstand the burning pressure and thus may be broken so that the fragments may be flied off to the surrounding to kill and wound occupants and persons around them. Accordingly, it is cited as the required term for the gas generator that the critical condition of the container, such as the fracture of the container, can be prevented even in such circumstances. To take measures to meet that situation, U.S. Pat. No. 4,561,675 proposed a system for the aluminum container, according to which the gunpowder that ignites automatically at a temperature lower than the temperature at which reduction of strength of aluminum is caused is arranged in close contact with an inner surface of the container. The automatic igniting gunpowder used therein includes nitrocellulose as a major component. Nitrocellulose itself lacks long-term stabilization under high temperature and further may ignite automatically due to that deterioration.

Smokeless powder having nitrocellulose as a major component has been equally used for the gas generating agent for use in the gas generator for a seatbelt pre-tensioner in terms of high burning velocity and autoignition capability, despite of the problems as mentioned above. Development of nitrocellulose is not originally intended for use in the gas generator and the oxygen balance in the composition (over and short oxygen in the combustion reaction) is not adjusted. Due to this, the use of nitrocellulose involves the problems of poorness in the combustion gas and very high combustion temperature.

The present invention aims to provide a gas generating agent that is good in generated gas composition and high in gasification rate by making choice of an oxidizer component of the gas generating agent having nitrogenous organic compound, nitroguanidine or aminotetrazole, in particular, as a fuel component which is a material effective for solving the problem of harmfulness of the metallic compound azide that has been used hitherto, whereby reduction in size and weight of the gas generator for use in the occupant protection device is accomplished.

Further preferably, the present invention aims provide the gas generating composition that is high in gasification rate, low in quantity of harmful NOx and CO gas components, excellent in heat resistance and small in volume of outflow slag and also holds an autoignition capability in the gas generating agent itself.

DISCLOSURE OF THE INVENTION

After having devotedly studied about any method for solving the above-noted problems, the inventors have found that the gas generating composition containing a combustion fuel, an oxidizing agent and an additive is allowed to have the property of being good in generated gas composition and high in gasification rate by using nitrogenous organic compound, nitroguanidine or aminotetrazole, in particular, as the major component and using the mixture of ammonium perchlorate and nitrate salt of alkaline metal or alkaline earth metal as the oxidizing agent, then leading to the present invention.

Specifically, the present invention is so designed that where a quantity of nitrate required solely for forming an oxide of alkaline metal or alkaline earth metal that can stoichiometrically neutralize hydrogen chloride generated from ammonium perchlorate is taken as 1, a quantity of nitrate of the alkaline metal or alkaline earth metal exceeds 0.9.

When ammonium perchlorate is used singly as the oxidizing agent, a 100% gasification rate can be obtained. But, harmful gas like hydrogen chloride is produced by the combustion of the ammonium perchlorate and also the combustion temperature is so high that the concentration of nitrogen oxides is increased. In order to solve these problems, the nitrate of the alkaline metal or alkaline earth metal is added to the ammonium perchlorate. The hydrogen chloride in particular is neutralized by the oxide of alkaline metal or alkaline earth metal originating from nitrate and is converted into water and harmless chloride.

Preferably, the amount of the nitrate of alkaline metal or alkaline earth metal added to the ammonium perchlorate is substantially equal to or slightly excess of the nitrate required solely for forming an oxide of alkaline metal or alkaline earth metal that can stoichiometrically neutralize hydrogen chloride generated from ammonium perchlorate. The oxides of alkaline metal or alkaline earth metal excessively produced are converted into materials that can be easily filtered by filters in the gas generator by the slag reaction with the slag collector mentioned later.

Further, when nitroguanidine is used as the fuel component, it is important that 15–30 weight % ammonium perchlorate and 20–40 weight % nitrate of the alkaline metal or alkaline earth metal are contained as the oxidizing agent relative to 35–60 weight % nitroguanidine.

When aminotetrazole is used as the fuel component, it is important that 20–40 weight % ammonium perchlorate and 25–55 weight % nitrate of the alkaline metal or alkaline earth metal are contained as the oxidizing agent relative to 20–45 weight % aminotetrazole.

It is preferable that said nitrate is at least one material selected from the group consisting of strontium nitrate, barium nitrate, potassium nitrate, and sodium nitrate.

According to the present invention, various kinds of additives are used to provide improvement in moldability, composition of generated gas, and slag formability. When the one material of the additives is the binder, it is preferable that hydrotalcites expressed by the following formula is contained as the binder and 2–10 weight % of hydrotalcites is contained in the composition:

$$[M^{2+}{}_{1-x}M^{3+}{}_{x}(OH)_2]^{x+}[A^{n-}{}_{x/n}.mH_2O]^{x-}$$

where $M^{2+}$ represents bivalent metal including $Mg^{2+}$, $Mn^{2+}$, $Fe^{2+}$, $Co^{2+}$, $Ni^{2+}$, $Cu^{2+}$ and $Zn^{2+}$;

$M^{3+}$ represents trivalent metal including $Al^{3+}$, $Fe^{3+}$, $Cr^{3+}$, $Co^{3+}$ and $In^{3+}$;

$A^{n-}$ represents an n-valence anion including $OH^-$, $F^-$, $Cl^-$, $NO_3^-$, $CO_3^{2-}$, $SO_4^{2-}$, $Fe(CN)_6^{3-}$, $CH_3COO^-$, ion oxalate and ion salicylate; and x: $0<x\leqq 0.33$.

Among others, it is preferable that the hydrotalcites are synthetic hydrotalcite or pyroaurite expressed by the following formulas:

(Synthetic Hydrotalcite)

Chemical formula: $Mg_6Al_2(OH)_{16}CO_3.4H_2O$ (Pyroaurite)

Chemical formula: $Mg_6Fe_2(OH)_{16}CO_3.4H_2O$

When the one material of the additives is a catalyst for enabling an autoignition of the gas generating composition (autoignition capability developing catalyst), it is preferable that at least one molybdenum compound selected from the group consisting of molybdenum trioxide, molybdic acid, ammonium molybdate, sodium molybdate, phosphomolybdic acid, ammonium phosphomolybdate and sodium phosphomolybdate is contained as the autoignition capability developing catalyst. It is preferable that 0.05–5 weight % of molybdenum compound is contained in the composition.

When the one material of the additives is a slag collector, it is preferable that at least one metal nitride or metal carbide is contained as the slag collector. Preferably, 0.5–5 weight % of at least one metal nitride or metal carbide is contained in the composition.

When the one material of the additives is an auxiliary molding agent suitable for molding into granules and the like, it is preferable that at least one water-soluble polymer selected from the group consisting of polyethylene glycol, polypropylene glycol, polyvinyl ether, copolymer of maleic acid and other polymerizable material, polyethylene imide, polyvinyl alcohol, polyvinyl pyrrolidone, polyacrylamide, sodium polyacrylate and ammonium polyacrylate is contained as the auxiliary molding agent. The water-soluble polymer solution may be sprayed on the gas generating composition and dried so as to form the granules of gas generating compositions. In this case, it is preferable that a 0.05–2 weight % addition of water-soluble polymer is contained in the composition.

When the one material of the additives is a press-forming-use lubricant suitable for molding into pellets and the like, it is preferable that at least one material selected from the group consisting of magnesium stearate, zinc stearate, graphite, boron nitride and molybdenum disulfide is mixed as the lubricant in the gas generating composition. Preferably, 0.1–1 weight % of lubricant is contained in the composition.

The gas generating composition of the present invention may be extruded into a cylindrical form having a single hole or a plurality of holes by adding an extrusion-molding-use binder. In this case, it is preferable that at least one material selected from the group consisting of organic or inorganic binders such as cellulosic compound, polyvalent hydroxy compound, polybinyl polymer, microbial polysaccharide and inorganic binder is mixed as the extrusion-molding-use binder in the gas generating composition before the extrusion molding. A 1–15 weight % of addition is preferable.

The gas generator of the present invention is a gas generator in which any of the above-mentioned gas generating compositions of the present invention is loaded.

BRIEF DESCRIPTION OF THE DRAWINGS

FIG. 4 is a diagram showing TABLE giving the composition ratios and the results of the 60 liter tank test and the autoignition property test; and FIG. 5 is a diagram showing TABLE giving the results of the combustion test and the heat resistance test.

BEST MODE FOR CARRYING OUT THE INVENTION

Figure 1:
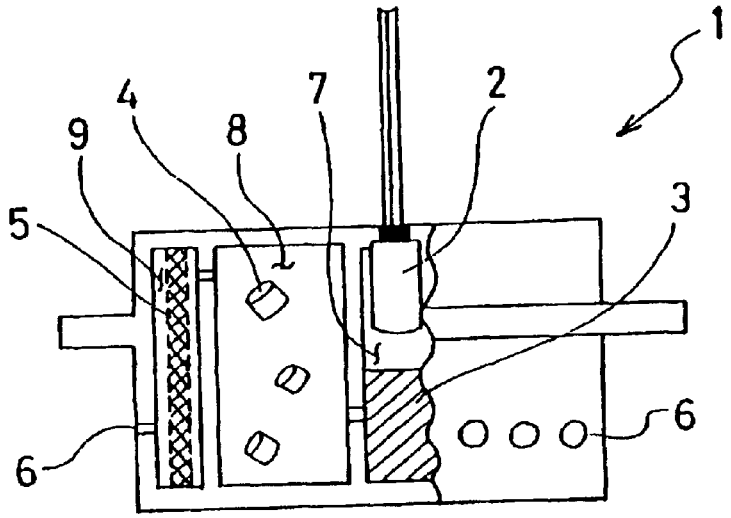
FIG. 1 is a schematic sectional view of a gas generator 1 used in an embodiment of the present invention.

The detailed description on the present invention will be given below. The gas generating agent of the present invention comprises nitrogenous organic compound in particular, nitroguanidine or aminotetrazole as a fuel component, and mixture of ammonium perchlorate and nitrate of alkaline metal or alkaline earth metal as an oxidizing agent used for burning the nitrogenous organic compound. Further, the gas generating agent of the present invention comprises a binder, an autoignition capability developing catalyst, a slag collector and other various kinds of auxiliary molding agent, which may selectively be added and mixed in accordance with the intended purpose. The gas generating composition of the present invention is characterized in that, we set a quantity of nitrate of the alkaline metal or alkaline earth metal exceeding 0.9 in the mixture of the oxidizing agent when a required quantity of nitrate for forming an oxide of alkaline metal or alkaline earth metal is regarded as one, the oxide can stoichiometrically neutralize hydrogen chloride generated from ammonium perchlorate.

It is preferable that the nitrate of the alkaline metal or alkaline earth metal is at least one material selected from the group consisting of readily available strontium nitrate, barium nitrate, potassium nitrate, and sodium nitrate.

Now, the nitrogenous organic compounds which may be used as a fuel component in the present invention will be described first. Preferable nitrogenous organic compounds are those that have a high proportion of an atom of nitrogen in the molecular structure and have the structure of inherently restraining from generating harmful CO gas and also are easy to handle including thermal stability and safety and low in price. Of those compounds, nitroguanidine and aminotetrazole are preferable in terms of reactivity with the oxidizing agent of the present invention.

When nitroguanidine is used as fuel component, the nitroguanidine content is preferably of between 35 and 60 weight % in the composition. With the content of not more than 35 weight %, a limited amount of gas is generated, so that an inflating failure of the air bag may possibly be caused. On the other hand, with the content added in excess of 60 weight %, the added amount of oxidizing agent is relatively reduced to cause incomplete combustion and, as a result of this, there is a possible fear that a large amount of harmful CO gas may be generated. Further, in the extreme, there is a possible fear that unburned material may be produced.

Thus, when the nitroguanidine content is of between 35 and 60 weight % in the composition, 15–30 weight % of ammonium perchlorate and 20–40 weight % of nitrate of the alkaline metal or alkaline earth metal are preferably contained as the oxidizing agent in the composition. It is noted here that a quantity of nitrate of the alkaline metal or alkaline earth metal is selected so as to exceed 0.9, where a quantity of nitrate required solely for forming an oxide of the alkaline metal or alkaline earth metal that can stoichiometrically neutralize hydrogen chloride generated from ammonium perchlorate is taken as 1, as mentioned above.

When aminotetrazole is used as fuel component, the aminotetrazole content is preferably of between 20 and 45 weight % in the composition. With the content of not more than 20 weight %, a limited amount of gas is generated, so that an inflating failure of the air bag may possibly be caused. On the other hand, with the content added in excess of 45 weight %, the added amount of oxidizing agent is relatively reduced to cause incomplete combustion and, as a result of this, there is a possible fear that a large amount of harmful CO gas may be generated. Further, in the extreme, there is a possible fear that unburned material may be produced.

Thus, when the aminotetrazole content is of between 20 and 45 weight % in the composition, 20–40 weight % of ammonium perchlorate and 25–55 weight % of nitrate of the alkaline metal or alkaline earth metal are preferably contained as the oxidizing agent in the composition. In this case also, a quantity of nitrate of the alkaline metal or alkaline earth metal is selected so as to exceed 0.9, where a quantity of nitrate required solely for forming an oxide of the alkaline metal or alkaline earth metal that can stoichiometrically neutralize hydrogen chloride generated from ammonium perchlorate is taken as 1, as mentioned above.

Then, the reaction formulas and gasification rates in the complete combustion in the reaction of nitroguanidine or aminotetrazole and the oxidizing agent are expressed by the following typical combination formulas (a) and (b).

(a) Reaction of Nitroguanidine and Mixtures of Ammonium Perchlorate/strontium Nitrate $$CH_4N_4O_2+0.4NH_4ClO_4+0.2Sr(NO_3)_2 \rightarrow 2.4N_2+CO_2+2.8H_2O+0.2SrCl_2$$

Gasification Rate: 83.6%

(b) Reaction of Aminotetrazole and Mixtures of Ammonium Perchlorate/strontium Nitrate $$CH_3N_5+0.7NH_4ClO_4+0.35Sr(NO_3)_2 \rightarrow 3.2N_2+CO_2+2.9H_2O+0.35SrCl_2$$

Gasification Rate: 77.0%

Then, typical combinations of reaction formulas and gasification rates in the use of the oxidizing agent including no ammonium perchlorate are expressed by the following formulas (c) and (d) as Comparative

EXAMPLES (c) Reaction of Nitroguanidine and Strontium Nitrate $$CH_4N_4O_2+0.4Sr(NO_3)_2 \rightarrow 2.4N_2+0.6CO_2+2H_2O+0.4SrCO_3$$

Gasification Rate: 68.7%

(d) Reaction of Aminotetrazole and Strontium Nitrate $$CH_3N_5+0.7Sr(NO_3)_2 \rightarrow 3.2N_2+0.3CO_2+1.5H_2O+0.7SrCO_3$$

Gasification Rate: 55.7%

Further, the inventors have found out the advantage in manufacturing safety resulting from the use of said mixed oxidizing agent. Specifically, the mixture of aminotetrazole and ammonium perchlorate or the mixture of aminotetrazole and strontium nitrate keeps on burning in the atmosphere without interruption, once they are ignited. On the other hand, the mixture of aminotetrazole and mixed oxidizing agent of ammonium perchlorate/strontium nitrate ignites temporarily but does not burn continuously in the atmosphere. This means that in the event that fire comes out in the manufacturing process of the mixture, the mixture of aminotetrazole and mixed oxidizing agent of ammonium perchlorate/strontium nitrate is resistant to burning propagation, thus providing considerably improved manufacturing safety. When nitroguanidine is used in combination with any one of the oxidizing agents of ammonium perchlorate, strontium nitrate and the mixture of ammonium perchlorate/strontium nitrate, no continuous burning in the atmosphere is found.

Then, the binders which may be used as a material of additives in the present invention will be described below. In the present invention, hydrotalcites expressed by the following general formula are of preferable:

$$[M^{2+}{}_{1-x}M^{3+}{}_{x}(OH)_2]^{x+}[A^{n-}{}_{x/n}.mH_2O]^{x-}$$

where $M^{2+}$ represents bivalent metal including $Mg^{2+}$, $Mn^{2+}$, $Fe^{2+}$, $Co^{2+}$, $Ni^{2+}$, $Cu^{2+}$and $Zn^{2+}$;

$M^{3+}$ represents trivalent metal including $Al^{3+}$, $Fe^{3+}$, $Cr^{3+}$, $Co^{3+}$ and $In^{3+}$;

$A^{n-}$ represents an n-valence anion including $OH^-$, $F^-$, $Cl^-$, $NO_3^-$, $CO_3^{2-}$, $SO_4^{2-}$, $Fe(CN)_6^{3-}$, $CH_3COO^-$, ion oxalate and ion salicylate; and x: $0<x\leqq 0.33$.

The hydrotalcites, which are a porous material having water of crystallization, are very useful as a binder for a gas generating agent of nitrogenous organic compound. This seems to be because the hydrotalcites have the common property of being liable to absorb moisture and that property serves to firmly bind the components of the composition.

For example, when pellets of the gas generating agent are formed by using the hydrotalcites as the binder, the pellets can provide a degree of hardness (25–30 kgf) much higher than a degree of hardness of 10–15 kgf (Monsant type hardness meter) of a pellet of a general type of azide base gas generating agent even in a low pelletization pressure. Also, the molded products such as the pellets using this binder keep their characteristic and combustion behavior unchanged against the thermal shock caused by temperature being raised and fallen repeatedly, thus enabling the pellets to be minimized in deterioration with age after practical installation on a vehicle, to be very stable in properties.

Typical of the hydrotalcites are synthetic hydrotalcite or pyroaurite expressed by the following formulas. The synthetic hydrotalcite is of preferable in terms of availability and costs.

(Synthetic Hydrotalcite)

Chemical formula: $Mg_6Al_2(OH)_{16}CO_3.4H_2O$ (Pyroaurite)

Chemical formula: $Mg_6Fe_2(OH)_{16}CO_3.4H_2O$

In the combustion of the gas generating agent, for example the synthetic hydrotalcite of the hydrotalcites decomposes as shown in the following reaction formula and produces no harmful gas. Further, the reaction itself is an endothermic reaction, thus providing an advantageous effect of reducing the combustion temperature of the gas generating agent and resultantly suppressing the production of NOx.

$$Mg_6Al_2(OH)_{16}CO_3.4H_2O \rightarrow 6MgO+Al_2O_3+CO_2+12H_2O$$

Further, the hydrotalcites are quite insensitive to friction sensitivity and drop hammer sensitivity which are reference indexes of the degree of risk of explosives. Thus, the addition of the hydrotalcites to the gas generating composition of the present invention provides the gas generating composition that is safe to handle. The result of the friction sensitivity test as is prescribed by JIS-K-4810 (Explosive Performance Testing Method) is presented here as one example of an evaluation of risk. For example, the composition of the nitroguanidine or aminotetrazole and the ammonium perchlorate/strontium nitrate having a 4-grade friction sensitivity is improved to have a 6-grade in safety by adding thereto the hydrotalcites of about 5 weight %.

When the hydrotalcites is added to the gas generating composition of the present invention as the binder, the hydrotalcites is added in the range of 2 to 10 weight %. A less than 2 weight % hydrotalcites has difficulties in serving as the binder, while on the other hand, a more than 10 weight % hydrotalcites causes reduction of an added amount of other components to lead to difficulties in serving as the gas generating composition. The hydrotalcites is preferably added in the range of 3 to 8 weight % in particular. Preferably, the hydrotalcites is of not more than 10 $\mu$m in a 50% average particle diameter of number of reference, so as to be dispersed uniformly in the gas generating composition.

It is noted that the 50% average particle diameter of number of reference is a measurement by which a size distribution is expressed on the basis of number: when the total number of particles is set to be 100, the particle size obtained when the particles integrated from the smaller number reach 50 is called the 50% average particle diameter of number of reference.

Then, the catalyst for enabling the autoignition of the gas generating composition used in the present invention (the autoignition capability developing catalyst) will be described below. To allow series of nitroguanidine or aminotetrazole, ammonium perchlorate and nitrate of alkaline metal or alkaline earth metal to have an autoignition capability at 150–210° C., the study was made of the presence of the autoignition capabilities by adding thereto various kinds of metal oxides, metal sulphide and metal powder. This study showed that molybdenum trioxide and molybdenum trioxides, i.e., compounds that produce the molybdenum trioxide by heating, have the autoignition capability.

The study also showed that even a very small quantity of 0.05 weight % addition to the gas generating composition developed the autoignition capability and that the capability was kept substantially unchanged in the range of between 0.05 weight % and 5 weight %. Thus, the molybdenum trioxide is preferably added as the catalyst for allowing them to have the autoignition capability in the range of between 0.05 weight % and 5 weight %. A less than 0.05 weight % addition develops no autoignition capability, while on the other hand, a more than 5 weight % addition develops a tendency of decreasing the gasification ratio.

The molybdenum trioxides which may be used include molybdeum compounds such as molybdic acid, ammonium molybdate, sodium molybdate, phosphomolybdic acid, ammonium phosphomolybdate and sodium phosphomolybdate. When the molybdenum compounds are added as a substitute for the molybdenum trioxide, the addition is preferably in the range of between 0.05 weight % and 5 weight % on a basis of the molybdenum trioxide produced.

Then, the slag collectors used in the present invention will be described below. The slag collectors which may be used in the present invention include metal nitrides and metal carbides. There may be cases where the metal nitrides include azides, but the metal nitrides defined by the present invention include no azides. The nitrides which may be used include at least one material selected from the group consisting of silicon nitride ($Si_3N_4$), boron nitride (BN), aluminum nitride (AlN), molybdenum nitride ($MoN/Mo_2N$), tungsten nitride ($WN_2/W_2N,W_2N_3$), titanium nitride (TiN), vanadium nitride (VN), zirconium nitride (ZrN), chromium nitride ($CrN/Cr_2N$), tantalum nitride (TaN), and niobium nitride (NbN).

Actual examples of the metal carbides which may be used in the present invention include silicon carbide (SiC), boron carbide ($B_4C$), molybdenum carbide ($MoC/Mo_2C$), tungsten carbide ($WC/W_2C$), titanium carbide (TiC), vanadium carbide (VC), zirconium carbide (ZrC), chromium carbide ($Cr_3C_2/Cr_7C_3/Cr_{23}C_6$), tantalum carbide (TaC) and niobium carbide (NbC). These may be used in mixture.

These metal nitrides and metal carbides, which are called fine ceramics, are used as heat-resistant materials which are thermally stable and high resistant, but they have the property of burning in high-temperature oxidizing atmospheres. In the present invention, the slag forming is performed through the use of their burning property. Simultaneously, the nitrogen gas and carbon dioxide gas generated by the combustion reaction are also used for the operation of the occupant protection system, as is the case with the combustion gas generated by the burning of the fuel components.

The reaction formula of the slag forming in the present invention is given below, taking silicon nitride as an example. The same applies to the other metal nitrides and the metal carbides. It is to be noted that coefficient of reaction is omitted.

$$Si_3N_4+O_2+MO \rightarrow 3MxSiOy+2N_2$$

where MO represents oxides of alkaline metal or alkaline earth metal or MgO and $Al_2O_3$ produced from the hydrotalcites.

According to the present invention, the metal oxide produced from oxidizing agent or the binder coexists with silicon nitride in the burning of the silicon nitride and thus silicate is formed. In general, the silicate has a melting point of about 1,600° C. and is in the molten state of high viscosity in the burning process of the gas generating agent, so that the fine particles of the slag are fused together to aggregate into large particles so as to be easily collected in the filtering members in the gas generator.

The particle diameter of the metal nitride or the metal carbide is not more than 5 $\mu$m, or preferably not more than 1 $\mu$m, in the 50% average particle diameter of number of reference, because the finer the particle diameter, the more that effect can be expected. Further, when a small quantity of fine particulate of the metal nitrides or metal carbides are added to the fuel component or oxidizing agent component when pulverized, those metal oxides or metal carbides can act as a cohesion preventing agent for the pulverized components and also can be dispersed uniformly in the oxidizing agent and the fuel, to ensure uniform reaction for the slag. When the metal nitride or metal carbide is used as the cohesion preventing agent, it may be used in combination with pulverized silica which is pulverized powder of silicon dioxide.

The added amount of the metal nitride or metal carbide depends on the oxide of alkaline metal or alkaline earth metal produced from the oxidizing agent and MgO and $Al_2O_3$ produced from the hydrotalcites. The addition is preferably in the range of 0.5 to 5 weight % of the gas generating composition. With the addition of less than 0.5 weight %, the adequate slag collecting effects cannot be expected, while on the other hand, with the addition of more than 5 weight %, the added amounts of fuel and oxidizing agent are limited, so that there presents a possible fear of shortage of gas generation and incomplete combustion.

Then, the auxiliary molding agent of one additive of the present invention and lubricant will be described below. In general, the gas generating agents are molded into a granule form, a pellet form, a disk-like form, a cylindrical form having a single hole or a cylindrical form having a plurality of holes so that a desired burning velocity and a sufficient strength of the molded product can be obtained for their intended use. The auxiliary molding agent and the lubricant are used to mold the gas generating agent into an actual use configuration.

When the gas generating agent is formed into a granule form, aqueous solution including water-soluble polymer used as the auxiliary molding agent is sprayed on the gas generating agent and mixed. Then, the mixture is molded into a granule form having a diameter of 1.0 mm or less and then water is eliminated from the molded product to thereby produce the granules. The granules may be used as they are, but may further be press-formed into a pellet form or a disk-like form for their intended use. Examples of the water-soluble polymer compounds which may be used include polyethylene glycol, polypropylene glycol, polyvinyl ether, copolymers of maleic acid and other polymerizable substances, polyethylene imide, polyvinyl alcohol, polyvinyl pyrrolidone, polyacrylamide, sodium polyacrylate and ammonium polyacrylate.

Preferably, the addition of 0.05–2 weight % water-soluble polymer is contained in the composition.

When the gas generating agents are press-formed into a pellet form or a disk-like form for their intended use, they are usually formed into pellets of 4–10 mm in diameter and 1.5–5 mm in thickness or disks of proper size. For the purpose of providing improved fluidity of powder or granules in the molding, at least one first lubricant selected from the group of, for example, stearic acid, zinc stearate, magnesium stearate, calsium stearate, aluminum stearate, molybdenum disulfide, graphite, and boron nitride is preferably added. This enables improvement of the moldability.

Preferably, the addition of 0.1–1 weight % lubricant is contained in the composition.

The gas generating agents formed into a pellet form or a disk-like form are heat-treated at 100–120° C. for about 2 to about 24 hours after formed to thereby produce the formed products of the gas generating agents which are resistant to deterioration with age. The heat-treatment is very effective particularly for passing harsh heat and aging tests of 107° C.×400 hrs. The heat-treatment for less than 2 hours is insufficient and that for more than 24 hours will be of meaningless, for the reason of which the heat-treatment time should be selected from the range of 2–24 hours, preferably 5–20 hours. Also, the heat-treatment at less than 100° C. is not effective and that at more than 120° C. may cause deterioration rather than improvement, for the reason of which the heat-treatment temperature should be selected from the range of 100–120° C., preferably 100–110° C.

The gas generating composition of the present invention may be extruded into a cylindrical form having a single hole or a plurality of holes by adding an extrusion-molding-use binder. In this case, the gas generating agents molded into the cylindrical form having a single hole have an outer diameter of 1–7 mm, an inner diameter of 0.5–2 mm and an entire length of 2–10 mm, which may be varied in accordance with their intended use. Preferably, the extrusion-molding-use binder to be mixed in the gas generating composition comprises at least one material selected from the group consisting of organic or inorganic binders including cellulosic compounds, polyvalent hydroxy compounds, polybinyl polymers and microbial polysaccharide. The mixture is extruded to form molded products. Preferably, the addition of 1–15 weight % binder is contained in the composition.

The gas generating agents of the invention thus extruded are heat-treated at 50–80° C. for about 20 to about 30 hours after formed to thereby produce the molded products of the gas generating agents which are resistant to deterioration with age. In the extrusion process, the molded products containing 20–30 weight % moisture are heat-treated, so that they must be heat-treated for a long time at low temperature. The heat-treatment is very effective particularly for passing harsh heat and aging tests of 107° C.×400 hrs. The heat-treatment for less than 20 hours is insufficient and that for more than 30 hours will be of meaningless, for the reason of which the heat-treatment time should be selected from the range of 20–30 hours. Also, the heat-treatment at less than 50° C. is not effective and that at more than 80° C. accelerates a moisture evaporation rate excessively to produce air bubbles in the molded product, which may cause a reduced strength and an abnormal burning in the combustion.

(Preferable Combination)

Now, some preferable combination of components of the gas generating composition of the present invention will be described below. Specifically, of the nitrogenous organic compounds, nitroguanidine and aminotetrazole are optimum fuel components. Of the mixtures of ammonium perchlorate and nitrate of alkaline metal or alkaline earth metal, the mixtures of ammonium perchlorate and strontium nitrate are optimum oxidizing agents.

When nitroguanidine is used as the fuel component, the fuel component is preferably contained in the gas generating agent in the range of 5–60 weight %. Then, 15–30 weight % ammonium perchlorate and 20–40 weight % strontium nitrate are preferably contained as the oxidizing components in the gas generating agent. When aminotetrazole is used as the fuel component, the fuel component is preferably contained in the gas generating agent in the range of 20–45 weight %. Then, 20–40 weight % ammonium perchlorate and 25–55 weight % strontium nitrate are preferably contained as the oxidizing components in the gas generating agent.

Molybdenum trioxide is an optimum autoignition capability developing catalyst. 0.05–5 weight % autoignition capability developing catalyst is preferably contained in the gas generating agent.

Silicon nitride is an optimum metal nitride of the slag collector, and silicon carbide is an optimum metal carbide. This is because silicon component of the slag collector is allowed to react with oxide produced from the nitrate of the alkaline metal or alkaline earth metal or oxide produced from the binders mentioned below in the process of combustion, to form readily collectable, high-viscosity slag. This slag collector is preferably contained in the gas generating agent in the range of 0.5–5 weight %.

Then, concrete examples of preferable binders will be given below. Synthetic hydrotalcites that can produce high-melting oxides of MgO and $Al_2O_3$ are an optimum binder for the gas generating agents to be press-formed into a pellet form or other like forms. These cause the slag reaction with silicon nitride or silicon carbide, as mentioned above, to produce the high-viscosity slag that is easily collected by the filtering part of the gas generator. This binder is preferably contained in the gas generating agent in the range of 2–10 weight %.

Polyvinyl alcohol is an optimum auxiliary molding agent for the gas generating agent to be molded into a granule form. This auxiliary molding agent is preferably contained in the gas generating agent in the range of 0.05–2 weight %.

In the case where the gas generating agent is formed into a granule form, the respective components are blended and then mixed by a V-type mixer. Then, aqueous solution in which water-soluble polymer of auxiliary molding agent is dissolved is sprayed on the mixture, which in turn is wet kneaded and granulated, so as to be molded into granules having a particle size of 1 mm or less. The granules is dried at 100° C. for 10 hours for use as the gas generating agent.

Magnesium stearate is an optimum lubricant for the gas generating agent to be press-formed into a pellet form. This lubricant is preferably added in the gas generating agent in the range of 0.1–1 weight %.

In the case where the gas generating agent is press-formed into a granule form or a disk-like form, the lubricant is added to the mixed powder produced by the V-type mixer and then the mixture is press-formed into a desired form and is dried at 100° C. for 10 hours for use as the gas generating agent. In this case, the lubricant may be added to the granules before the agent is press-formed.

Cellulosic compounds are an optimum binder for the gas generating agent to be extruded into a cylindrical form having a single hole or a plurality of holes. This extrusion-molding-use binder is preferably added in the gas generating agent in the range of 1–10 weight %.

In the case of extrusion molding, the fuel, the oxidizing agent and various kinds of additives are weighed in a spiral mixer and then 25 weight % water is added thereto at outer percentage and fully blended to produce a wet agent having viscosity. Thereafter, the wet agent is passed through a die that can extrude a material into a desired form and is cut to a required length. The extruded products thus obtained is heat-treated at 60° C. for 24 hours for use as the gas generating agent.

EXAMPLES

Further specific description of the present invention will be made with reference to Examples below.

A variety of gas generating agents were prepared in such a manner as to mentioned in Examples 1 to 4 and then loaded in the gas generators as shown in FIG. 1, respectively. Then, 60 liter tank tests and autoignition capability tests were carried out by use of the gas generators 1.

In FIG. 1, the gas generator 1 comprises a central ignition chamber 7 placing therein an ignitor 2 and a enhancer 3; a combustion chamber 8 provided around the ignition chamber and loading therein the gas generating agents 4; and a cooling/filtering chamber 9 provided outside of the combustion chamber and disposing therein a metal filter 5. The combustion gas is exhausted outside from gas exhausting holes 6 in a housing, passing through the cooling/filtering chamber 9.

Figure 2:
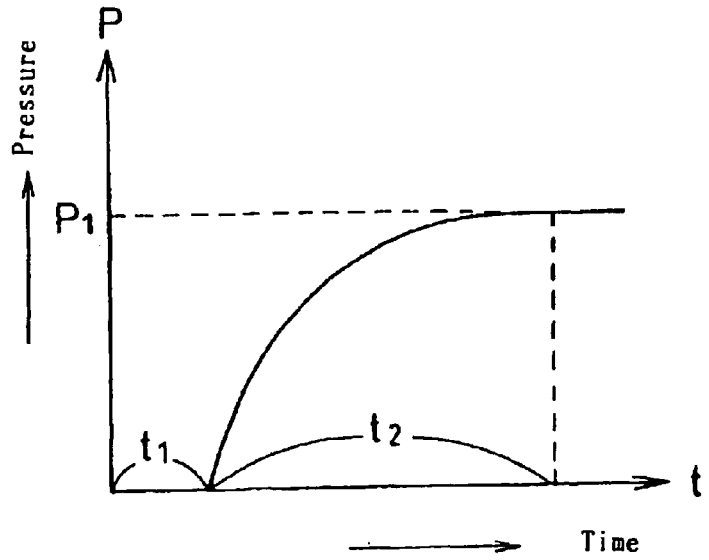
FIG. 2 is a graph showing the relation between the time (t) in a combustion test using a high-pressure vessel and the pressure (P) in the vessel.

In the 60 liter tank test, the gas generator placed in a high pressure vessel having an internal volume of 60 liter is put in action to release the gas in the vessel, and changes of the internal pressure with time as shown in FIG. 2 and the quantity of slag flown into the vessel are measured. In FIG. 2, an ordinate represents the internal pressure P of the vessel; an abscissa represents time t; $P_1$ represents a maximum range pressure in the vessel (Kpa); $t_1$ represents the time before the start of operation of the gas generator from the power supply to the ignitor 2 (ms:millisecond); and $t_2$ represents a required time (ms) for the pressure to reach $P_1$ after the operation of the gas generator.

Further, the autoignition capability was tested by use of the test-use gas generators in a test procedure called an outside fire test, through which the presence of autoignition capability against the fire and the like can be seen.

The outside fire test is a test procedure in which after the test-use gas generator is placed on cumulated woods which then are oiled with lamp oil and ignited, the test-use gas generator is allowed to stand in the flame for 10–30 minutes to examine on whether or not the gas generator is damaged by the burning of the gas generating agents. The results of the 60 liter tank tests and the results of the autoignition capability tests are shown as TABLE 1 in FIG. 4.

Example 1

49.0 weight % nitroguanidine used as the fuel component, 22.0 weight % ammonium perchlorate and 22.4 weight % strontium nitrate used as the oxidizing agent, 4.5 weight % synthetic hydrotalcite used as the binder, 0.9 weight % molybdenum trioxide used as the autoignition capability developing catalyst, 0.9 weight % silicon nitride used as the slag collector and 0.3 weight % magnesium stearate used as the pellet-forming-use lubricant were formulated and dry-blended with the V-type mixer. Before the mixing, impalpable powders of the silicon nitride (0.2 $\mu$m in the 50% average particle diameter of number of reference) were added in advance to the strontium nitrate. Then, the mixture was pulverized to about 12 $\mu$m in the 50% average particle diameter of number of reference. As for the ammonium perchlorate, APD2 (brand name) available from Japan Carlit Co., Ltd. was used as it is. The mixture was press-formed with a rotary type tablet making apparatus to obtain the gas generating pellets of 6 mm in diameter, 2.2 mm in thickness and 120 mg in weight. Then, the pellets were heat-treated at 100° C. for 10 hours. 25 g of the pellets thus obtained were loaded in the airbag-use gas generator 1 having the structure shown in FIG. 1. The test results are shown as TABLE 1 in FIG. 4.

Example 2

40.0 weight % nitroguanidine used as the fuel component, 25.0 weight % ammonium perchlorate and 25.8 weight % strontium nitrate used as the oxidizing agent, 2.4 weight % synthetic hydrotalcite, 0.9 weight % molybdenum trioxide used as the autoignition capability developing catalyst, 0.9 weight % silicon nitride used as the slag collector and 5.0 weight % sodium carboxymethylcellulose used as the molding-use binder (available from Wako Junyaku Kogyo Kabushiki Kaisha, chemical-use) were weighed in the spiral mixer and 25 weight % water was added to the mixed powder and kneaded.

The wet agents as fully kneaded into clayey clod were passed through the extruding machine so as to be extruded into the cylindrical form having a single hole having an outer diameter of 2 mm and an inner diameter of 1 mm and cut to an entire length of 3 mm.

Then, the extruded products were heat-treated at 60° C. for 24 hours. Before the mixing, impalpable powders of the silicon nitride (0.2 μm in the 50% average particle diameter of number of reference) were added in advance to the strontium nitrate and then the mixture was pulverized to about 12 μm in the 50% average particle diameter of number of reference. After the heat treatment, 25 g of the molded products thus obtained were loaded in the airbag-use gas generator 1 having the structure shown in FIG. 1. The test results are shown as TABLE 1 in FIG. 4.

Example 3

33.0 weight % 5-aminotetrazole used as the fuel component, 30.1 weight % ammonium perchlorate and 30.1 weight % strontium nitrate used as the oxidizing agent, 4.7 weight % synthetic hydrotalcite used as the binder, 0.9 weight % molybdenum trioxide used as the autoignition capability developing catalyst, 0.9 weight % silicon nitride used as the slag collector and 0.3 weight % magnesium stearate used as the pellet-forming-use lubricant were formulated and dryblended with the V-type mixer. Before the mixing, impalpable powders of the silicon nitride (0.2 μm in the 50% average particle diameter of number of reference) were added in advance to the 5-aminotetrazole and the strontium nitrate, respectively, by amounts that were nearly proportionally allotted corresponding to their weights. Then, the mixture was pulverized to about 12 μm in the 50% average particle diameter of number of reference. As for the ammonium perchlorate, APD2 (brand name) available from Japan Carlit Co., Ltd. was used as it is. The mixture was press-formed with the rotary type tablet making apparatus to obtain the gas generating pellets of 6 mm in diameter, 2.2 mm in thickness and 125 mg in weight. Then, the pellets were heat-treated at 100° C. for 10 hours. 25 g of the pellets thus obtained were loaded in the airbag-use gas generator 1 having the structure shown in FIG. 1. The test results are shown as TABLE 1 in FIG. 4.

Example 4

33.7 weight % 5-aminotetrazole used as the fuel component, 30.2 weight % ammonium perchlorate and 29.7 weight % potassium nitrate used as the oxidizing agent, 4.7 weight % synthetic hydrotalcite used as the binder, 0.5 weight % molybdenum trioxide used as the autoignition capability developing catalyst, 0.9 weight % silicon nitride used as the slag collector and 0.3 weight % magnesium stearate used as the pellet-forming-use lubricant were formulated and blended and molded in the same manner as in Example 3, to produce the pellets of 6 mm in diameter, 2.2 mm in thickness and 116 mg in weight. Before the mixing, impalpable powders of the silicon nitride (0.2 μm in the 50% average particle diameter of number of reference) were added in advance to the 5-aminotetrazole and the strontium nitrate, respectively, by amounts that were nearly proportionally allotted corresponding to their weights. Then, the mixture was pulverized to about 12 μm in the 50% average particle diameter of number of reference. Then, the obtained pellets were heat-treated at 100° C. for 10 hours. Thereafter, 25 g of the pellets were loaded in the airbag-use gas generator 1 having the structure shown in FIG. 1. The test results are shown as TABLE 1 in FIG. 4.

Comparative Example 1

51.7 weight % nitroguanidine used as the fuel component, 41.7 weight % strontium nitrate used as the oxidizing agent, 0.9 weight % molybdenum trioxide used as the autoignition capability developing catalyst, 0.9 weight % silicon nitride used as the slag collector, 4.5 weight % synthetic hydrotalcite used as the binder and 0.3 weight % magnesium stearate used as the pellet-forming-use lubricant were formulated and then were blended and molded in the same manner as in the Example 1, to produce the pellets of 6 mm in diameter, 2 mm in thickness and 120 mg in weight. Before the mixing, impalpable powders of the silicon nitride (0.2 μm in the 50% average particle diameter of number of reference) were added in advance to the strontium nitrate and then the mixture was pulverized to about 110 μm in the 50% average particle diameter of number of reference. The obtained pellets were heat-treated at 100° C. for 10 hours. Thereafter, 25 g of the pellets were loaded in the airbag-use gas generator 1 having the structure shown in FIG. 1. The test results are shown as TABLE 1 in FIG. 4. No autoignition capability test was carried out.

Comparative Example 2

32.6 weight % 5-aminotetrazole used as the fuel component, 60.6 weight % strontium nitrate used as the oxidizing agent, 0.9 weight % molybdenum trioxide used as the autoignition capability developing catalyst, 0.9 weight % silicon nitride used as the slag collector, 4.7 weight % synthetic hydrotalcite used as the binder and 0.3 weight % magnesium stearate used as the pellet-forming-use lubricant were formulated and then were blended and molded in the same manner as in the Example 3, to produce the pellets of 6 mm in diameter, 2.2 mm in thickness and 125 mg in weight. Before the mixing, impalpable powders of the silicon nitride (0.2 μm in the 50% average particle diameter of number of reference) were added in advance to the 5-aminotetrazole and the strontium nitrate, respectively, by amounts that were nearly proportionally allotted corresponding to their weights. Then, the mixture was pulverized to about 12 μm in the 50% average particle diameter of number of reference. The obtained pellets were heat-treated at 100° C. for 10 hours. Thereafter, 25 g of the pellets were loaded in the airbag-use gas generator 1 having the structure shown in FIG. 1. The test results are shown as TABLE 1 in FIG. 4. No autoignition capability test was carried out.

Comparative Example 3

44 g of gas generating pellets used in Comparative Example 1 were loaded in the airbag-use gas generator 1 having the structure shown in FIG. 1. The test results are shown as TABLE 1 in FIG. 4.

Comparative Example 4

44 g of gas generating pellets used in Comparative Example 2 were loaded in the airbag-use gas generator 1 having the structure shown in FIG. 1. The test results are shown as TABLE 1 in FIG. 4.

The quantities of slag flown out are expressed by weight (g) of solid residues ejected from the gas exhausting holes 6 of the test-use gas generator shown in FIG. 1 as were collected from the inside of the vessel. The quantities (ppm) of CO, NOx (including NO and $NO_2$), HCl and $Cl_2$ which are harmful gas for a human body were determined by making an analysis of the gas, which is accumulated in the 60 liter vessel after the gas generator is put in action, by using a prescribed gas detector.

From the tests on the autoignition capability of the compositions shown in Examples it was confirmed that no gas generators were damaged by the burning of the gas generating agents which was caused about 8 minutes past after the woods were ignited, so that all the compositions have the autoignition capabilities.

When comparison was made between Examples and Comparative Examples using the same quantity (25 g) of gas generating agents, it is seen that Examples show more desirable values as the occupant-protection-purpose gas generating agents on the combustion behavior of both the maximum range pressure $P_1$ in the vessel and the time $t_2$ required for the pressure to reach $P_1$ from the start of operation of the gas generator. Further, although Examples used the ammonium perchlorate, which it is feared generates a harmful gas like hydrogen chloride, as the oxidizing agent, no hydrogen chloride was detected. In addition, it was found that Examples generated very little CO and NOx that are harmful gases for a human body.

Comparative Examples 1–4 show the examples using strontium nitrate singly as the oxidizing agent without any ammonium perchlorate. When the amounts of the agents used in Comparative Examples are calculated by coordination with those used in Examples, one half of the values of the maximum range pressure $P_1$ of Examples was obtained. It is seen from the results of Comparative Examples 1 and 2 that although those values are affected by the difference in heat release values in the burning of the gas generating agents, they reflect well on the difference in the gasification rate and therefore the gas generating compositions of the present invention have a high gasification rate, as compared with the conventional gas generating compositions.

Further, in Comparative Examples 3 and 4, the amounts of agents were increased to 44 g so that the maximum range pressure $P_1$ could be in the same level as that of Examples, before the tests were carried out. In the outside fire tests, it was found that the gas produces were damaged and thus those agents had no autoignition capability. In this Comparative Example, when the strontium nitrate was used as the oxidizing agent, it was found that the concentration of NOx and the quantity of slag flown out increased.

Figure 3:
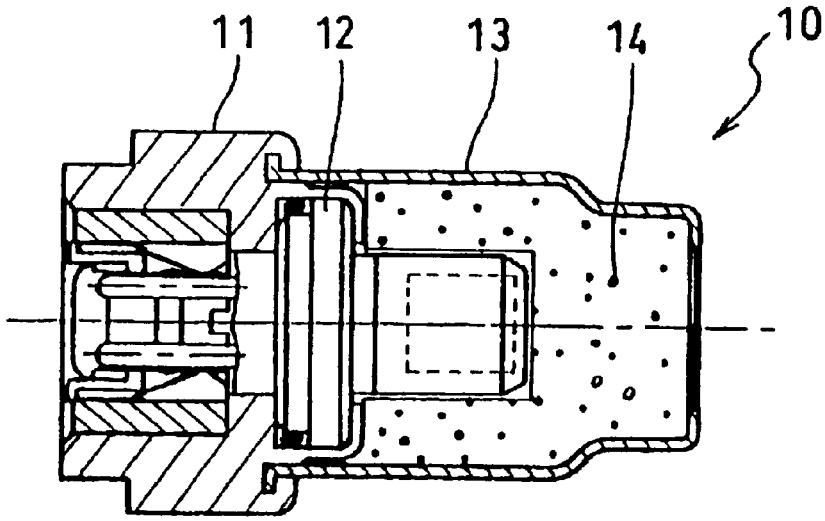
FIG. 3 is a schematic sectional view of a gas generator 10 for a seatbelt pre-tensioner used in an embodiment of the present invention.

Then, the tests were made of the combustion behavior of the gas generators for use in the seatbelt pre-tensioner. A variety of gas generating agents were blended as described in Examples 5 and 6 and then were loaded in the gas generators 10 for use in the seatbelt pre-tensioner as shown in FIG. 3.

The gas generator 10 comprises an ignition support member 11, an electric igniter 12 and a loading cylinder 13. The gas generating agents 14 were loaded in the loading cylinder 13. The combustion gas of the gas generating agents 14 is exhausted from a bottom of the loading cylinder 13. The gas generator 10 was placed in a high pressure vessel having an internal volume of 10 milliliter and then was put in action to release the gas in the vessel, and changes of the internal pressure of the vessel with time were measured as shown in FIG. 2 used in Example 1.

Also, the gas generator 10 was placed in the 60 liter tank used in Example 1 and was put in action and, then, the combustion gas analysis was made with the gas detector. Further, the gas generating agents were allowed to stand at 120° C. for 50 hours to examine their heat resistance and then the reduction of weight was measured. The results of those tests are shown as TABLE 2 in FIG. 5.

Example 5

49.0 weight % nitroguanidine used as the fuel component, 22.3 weight % ammonium perchlorate and 22.3 weight % strontium nitrate used as the oxidizing agent, 4.5 weight % synthetic hydrotalcite, 0.9 weight % molybdenum trioxide used as the autoignition capability developing catalyst and 0.9 weight % silicon nitride used as the slag collector were formulated and mixed by the V-type mixer. Thereafter, polyvinyl alcohol aqueous solution used as the auxiliary molding agent was sprayed on the mixture, which in turn was wet kneaded and granulated so as to be molded into granules having a particle size of 1 mm or less. The quantity of the polyvinyl alcohol aqueous solution was then contained 0.1 weight % in the mixture. The granules were dried at 100° C. for 10 hours. Thereafter, 1.0 g of granules were loaded in the seatbelt-pre-tensioner-use gas generator 10 having the structure shown in FIG. 3 and the tests were made. The test results are shown as TABLE 2 in FIG. 5.

Example 6

33.0 weight % 5-aminotetrazole used as the fuel component, 30.3 weight % ammonium perchlorate and 30.3 weight % strontium nitrate used as the oxidizing agent, 4.5 weight % synthetic hydrotalcite used as the binder, 0.9 weight % molybdenum trioxide used as the autoignition capability developing catalyst and 0.9 weight % silicon nitride used as the slag collector were mixed with the V-type mixer. Thereafter, polyvinyl alcohol aqueous solution used as the auxiliary molding agent was sprayed on the mixture, which in turn was wet kneaded and granulated so as to be molded into granules having a particle size of 1 mm or less. The quantity of the polyvinyl alcohol aqueous solution was then contained 0.1 weight % in the mixture. The granules were dried at 100° C. for 10 hours. Thereafter, 1.0 g of granules were loaded in the seatbelt-pre-tensioner-use gas generator 10 having the structure shown in FIG. 3 and the tests were made. The test results are shown as TABLE 2 in FIG. 5.

Comparative Example 5

The same tests as those in Example 5 were made by using 1.0 g single base smokeless powder having nitrocellulose as a major component. The test results are shown as TABLE 2 in FIG. 5.

As evident from TABLE 2, the gas generating composition of the present invention has remarkable characteristics of good composition of the combustion gas and excellent heat resistance. With the known smokeless powder, the concentration of CO is 4,500 ppm, whereas, with the gas generating agent of the present invention, the concentration of CO is considerably improved to 700–900 ppm. This is obvious from the results of Examples mentioned above. Further, it was seen from the fact that no weight was found to reduce even when the agents were allowed to stand in the state of high temperature of 120° C. that the agents have good heat resistance.

(Effects of the Invention)

According to the present invention, in the gas generating composition comprising a fuel component, an oxidizing agent and an additive, a nitrogenous organic compound, nitroguanidine or aminotetrazole, in particular, is used as a fuel component and also the mixture of ammonium perchlorate and nitrate of alkaline metal or alkaline earth metal as the oxidizing agent, so as to provide a high gasification rate. Also, the fuel component is nitrogenous organic compound, so that a good gas that produces little CO gas is obtained.

In addition, where a quantity of nitrate required solely for forming an oxide of alkaline metal or alkaline earth metal that can stoichiometrically neutralize hydrogen chloride generated from ammonium perchlorate is taken as 1, a quantity of nitrate of the alkaline metal or alkaline earth metal exceeds 0.9. By virtue of this, despite of ammonium perchlorate being used, little harmful gas like hydrogen chloride and the like is generated.

Further, when the hydrotalcites are used as the binder, the generation of NOx is also suppressed.

The addition of proper additives to the fuel component and the oxidizing agent can produce excellent heat resistance and reduced quantity of outflow slag and can hold an autoignition capability in the gas generating agent.

When the gas generating composition of the present invention is used as the gas generating composition for use in the airbag gas generator, the metal oxide produced from the oxidizing agent and the other metal oxides produced in the combustion process cause slag forming reaction with metal nitride or metal carbide added as the slag collector, so that they are converted into material that can be easily filtered by the filter. This can produce clean gas and also enables reduction in size and weight.

When the gas generating composition of the present invention is used as the gas generating composition for use in the seatbelt pre-tensioner gas generator, a small amount of gas generating composition used is needed and thus a small quantity of slag is produced, thus requiring no filter for the use.

Capabilities of Exploitation in Industry

The present invention is optimum as the gas generating composition that contains nitrogenous organic compound, nitroguanidine or aminotetrazole, in particular, as a fuel component, so as to produce clean gas for a human body at high gasification rate.

Further, the present invention is optimum as the gas generating composition having high gasification rate that is low in quantity of harmful NOx and CO gas components in the generated gas, excellent in heat resistance and small in volume of outflow slag and also holds an autoignition capability in the gas generating agent itself.

What is claimed is:

1. An extruded gas generant molding comprising 35–60 weight % nitroguanidine fuel component, oxidizing agents of 15–30 weight % ammonium perchlorate and 20–40 weight % nitrate of an alkaline earth metal and at least one additive, wherein the additive is an extrusion-molding use binder of 1–15 weight % of at least one cellulosic compound or microbial polysaccharide.

2. The extruded gas generant molding according to claim 1, wherein the cellulosic compound is cellulose.

3. A gas generator in which the gas generating composition according to claim 1 is loaded.

4. A gas generator in which the gas generating composition according to claim 2 loaded.

* * * * *